US009843116B2

(12) United States Patent
Endo et al.

(10) Patent No.: US 9,843,116 B2
(45) Date of Patent: Dec. 12, 2017

(54) ELECTRICAL CONNECTOR

(71) Applicant: DAI-ICHI SEIKO CO., LTD., Kyoto (JP)

(72) Inventors: Takayoshi Endo, Shizuoka (JP); Yoshimitsu Hashimoto, Fukuoka (JP); Sakai Yagi, Shizuoka (JP); Takashi Morita, Fukuoka (JP); Shogo Jinnouchi, Fukuoka (JP)

(73) Assignee: DAI-ICHI SEIKO CO., LTD. (JP)

( * ) Notice: Subject to any disclaimer, the term of this patent is extended or adjusted under 35 U.S.C. 154(b) by 0 days.

(21) Appl. No.: 15/072,136

(22) Filed: Mar. 16, 2016

(65) Prior Publication Data

US 2016/0276761 A1 Sep. 22, 2016

(30) Foreign Application Priority Data

Mar. 19, 2015 (JP) ..... 2015-056487

(51) Int. Cl.
*H01R 13/436* (2006.01)
*H01R 13/506* (2006.01)
(Continued)

(52) U.S. Cl.
CPC ..... *H01R 12/585* (2013.01); *H01R 12/716* (2013.01); *H01R 12/724* (2013.01);
(Continued)

(58) Field of Classification Search
CPC .. H01R 12/585; H01R 12/716; H01R 12/724; H01R 13/506; H01R 24/64;
(Continued)

(56) References Cited

U.S. PATENT DOCUMENTS 4,857,017 A * 8/1989 Erk ..... H01R 12/724 439/695
5,203,722 A * 4/1993 Kinoshita ..... H01R 13/4362 439/595
(Continued)

FOREIGN PATENT DOCUMENTS

JP 2000-003744 A 1/2000 ..... H01R 12/22
JP 2001-006771 A 1/2001 ..... H01R 12/04
(Continued)

*Primary Examiner* — Edwin A. Leon
*Assistant Examiner* — Paul Baillargeon
(74) *Attorney, Agent, or Firm* — Hayes Soloway P.C.

(57) ABSTRACT

An electrical connector includes: a conductive terminal including: a connector-side connecting part; a substrate-side connecting part; and an L-shaped bent part therebetween; a housing including: a terminal-holding hole holding the conductive terminal between the connector-side connecting part and the bent part; and an opening capable of exposing the substrate-side connecting part. The opening is used for connecting a circuit substrate. An alignment member is attached toward the substrate-side connecting part of the conductive terminal so as to close the opening. The alignment member is engaged with the housing in a state where the substrate-side connecting part projects from a through hole for inserting the conductive terminal therein. The engaging unit preventing the substrate-side connecting part of the conductive terminal from moving to the bent part, is provided between the conductive terminal and the through hole.

5 Claims, 21 Drawing Sheets

(51) Int. Cl.
*H01R 12/58* (2011.01)
*H01R 12/72* (2011.01)
*H01R 12/71* (2011.01)
*H01R 24/64* (2011.01)

(52) U.S. Cl.
CPC ..... *H01R 13/4362* (2013.01); *H01R 13/506* (2013.01); *H01R 13/436* (2013.01); *H01R 13/4361* (2013.01); *H01R 24/64* (2013.01)

(58) Field of Classification Search
CPC ..... H01R 13/436; H01R 13/4361; H01R 13/4362; H01R 13/4368; H01R 13/4367
USPC ..... 439/752
See application file for complete search history.

(56) References Cited

U.S. PATENT DOCUMENTS 5,453,016 A * 9/1995 Clark ..... H01R 12/724 439/79
5,516,309 A * 5/1996 Sayer ..... H01R 13/4362 439/603
5,688,129 A * 11/1997 Flaherty ..... H01R 12/716 439/79
5,807,119 A * 9/1998 Baechtle ..... H01R 13/516 439/540.1
6,334,783 B1 1/2002 Hu ..... 439/84
6,375,478 B1 4/2002 Kikuchi ..... 439/79
6,719,573 B2 * 4/2004 Koehler ..... H01R 12/585 29/837
7,722,366 B2 * 5/2010 Yamamoto ..... H01R 12/58 439/79
9,484,654 B2 * 11/2016 Du ..... H01R 13/428
2001/0023142 A1 9/2001 Miwa et al. ..... 439/79
2005/0085109 A1 4/2005 Tanaka et al. ..... 439/79
2011/0053427 A1 * 3/2011 Tung ..... H01R 13/4361 439/660

FOREIGN PATENT DOCUMENTS

JP 2001-266994 A 9/2001 ..... H01R 13/46
JP 2005-123120 A 5/2005 ..... H01R 12/22

* cited by examiner

ELECTRICAL CONNECTOR

BACKGROUND OF THE INVENTION

1. Field of the Invention

The present invention relates to an electrical connector attached to a circuit substrate to be used.

2. Description of the Related Art

For example, Reference 1 (Japanese Patent Application Laid-open on No. 2005-123120) discloses a "substrate connector" as conventional art related to the present invention. The substrate connector recited in Reference 1 is provided with an alignment plate that is a restricting member for preventing side walls of a housing from expanding.

More concretely, as shown in FIG. 1 and FIG. 2 of Reference 1, a housing _20 includes: a terminal holder _22 capable of holding terminal fittings _21; a pair of side walls _24 projecting and extending backward from the terminal holder _22; and a substrate-fixing part _25 expanding outward from outer side surfaces of the side walls _24. A screw-fastening hole _29 capable of being screwed by a tapping screw penetrating a screw-inserting hole _12 of a substrate _10, is provided with the substrate-fixing part _25. Screwing the tapping screw into the screw-fastening hole _29 enables to fix the housing _20 onto the substrate _10.

An alignment plate _40 is attached between the pair of side walls _24. A restricted part _30 is provided on inner surfaces of the side walls _24. A restricting part _43 can be engaged with the restricted part _30, and is provided with both side edges of the alignment plate _40. Engaging the restricting part _43 with the restricted part _30 enables to control the side walls _24 not to expand while screwing the tapping screw.

LIST OF CITED REFERENCE(S)

Reference 1: Japanese Patent Application Laid-open on No. 2005423120

OBJECTS AND SUMMARY OF THE INVENTION

The substrate connector in Reference 1 does not possess means for receiving external force (reaction force) that acts from the circuit substrate to a conductive terminal. Upon attaching the substrate connector onto the circuit substrate, if the external force (reaction force) acts from the circuit substrate to a substrate-side connecting part of the conductive terminal, the conductive terminal runs and the substrate-side connecting part is not be pressed into a normal position of the circuit substrate in some cases.

In view of the above, an object of the present invention is to provide an electrical connector whose substrate-side connecting part of the conductive terminal dose not run even if the external force (reaction force) acts from the circuit substrate to the conductive terminal upon attaching the substrate connector including an alignment member onto the circuit substrate.

A first aspect of the present invention provides an electrical connector, comprising: a conductive terminal including: a connector-side connecting part; a substrate-side connecting part; and an L-shaped bent part therebetween; a housing including: a terminal-holding hole holding the conductive terminal between the connector-side connecting part and the bent part; and an opening capable of exposing the substrate-side connecting part, the opening being used for connecting a circuit substrate; an alignment member attached toward the substrate-side connecting part of the conductive terminal so as to close the opening, the alignment member being engaged with the housing in a state where the substrate-side connecting part projects from a through hole for inserting the conductive terminal therein, wherein an engaging unit preventing the substrate-side connecting part of the conductive terminal from moving to the bent part, is provided between the conductive terminal and the through hole.

In the electrical connector with this structure, the substrate-side connecting part of the conductive terminal held by the terminal-holding hole of the housing, projects from the through hole of the alignment member attached so as to close the opening of the housing. And, there is, between the conductive terminal and the through hole, the engaging unit preventing the substrate-side connecting part of the conductive terminal from moving to the bent part.

Accordingly, the substrate-side connecting part of the conductive terminal never runs even if the external force (reaction force) acts from the circuit substrate to the conductive terminal upon attaching the substrate connector onto the circuit substrate.

A second aspect of the present invention provides, in addition to the first aspect, the electrical connector wherein the engaging unit includes an uneven engaging mechanism that engages with the conductive terminal when the alignment member attached with the opening slides in a direction that crosses the substrate-side connecting part of the conductive terminal.

With this structure, comparatively easy work of making the alignment member slide in the determined direction enables to surely engage the alignment member with the substrate-side connecting part of the conductive terminal.

A third aspect of the present invention provides, in addition to the second aspect, the electrical connector wherein the uneven engaging mechanism includes: a projecting shoulder part provided with the conductive terminal; and a recessed holding part provided in the through hole of the alignment member so as to fit the projecting shoulder part thereinto.

With this structure, the projecting shoulder part fits into the recessed holding part to produce a stable engagement state. And, this is also effective in preventing the substrate-side connecting part of the conductive terminal from running to the bent part.

A fourth aspect of the present invention provides, in addition to the third aspect, the electrical connector wherein a guide surface guiding the projecting shoulder part toward the recessed holding part, is provided between an inner peripheral surface of the through hole and the recessed holding part when the alignment member slides in the direction that crosses the substrate-side connecting part.

A fifth aspect of the present invention provides, in addition to the first aspect, the electrical connector wherein the substrate-side connecting part of the conductive terminal includes a press-fit mechanism.

A sixth aspect of the present invention provides, in addition to the first aspect, the electrical connector further comprising: a lock mechanism preventing the alignment member attached with the opening of the housing from being detached therefrom.

Effect of Invention

According to the present invention, the electrical connector whose substrate-side connecting part of the conductive terminal dose not run even if the external force (reaction force) acts from the circuit substrate to the conductive terminal upon attaching the substrate connector including an alignment member onto the circuit substrate, can be provided.

DETAILED DESCRIPTION OF THE PREFERRED EMBODIMENTS

Embodiment 1

Embodiments of the present invention are now described with reference to the accompanying drawings.

Figure 1:
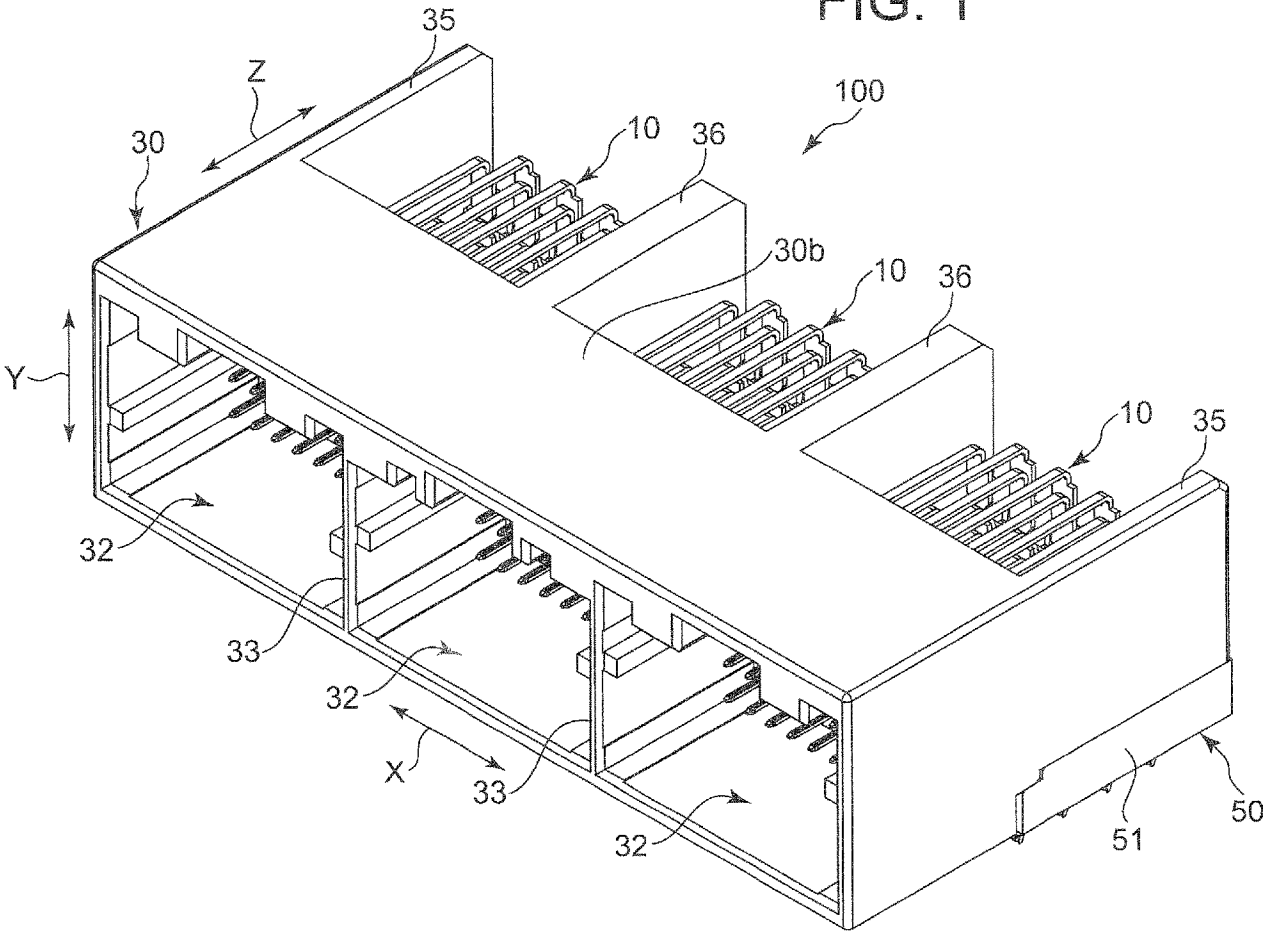
FIG. 1 is a perspective view of an electrical connector in Embodiment 1 according to the present invention.
Figure 2:
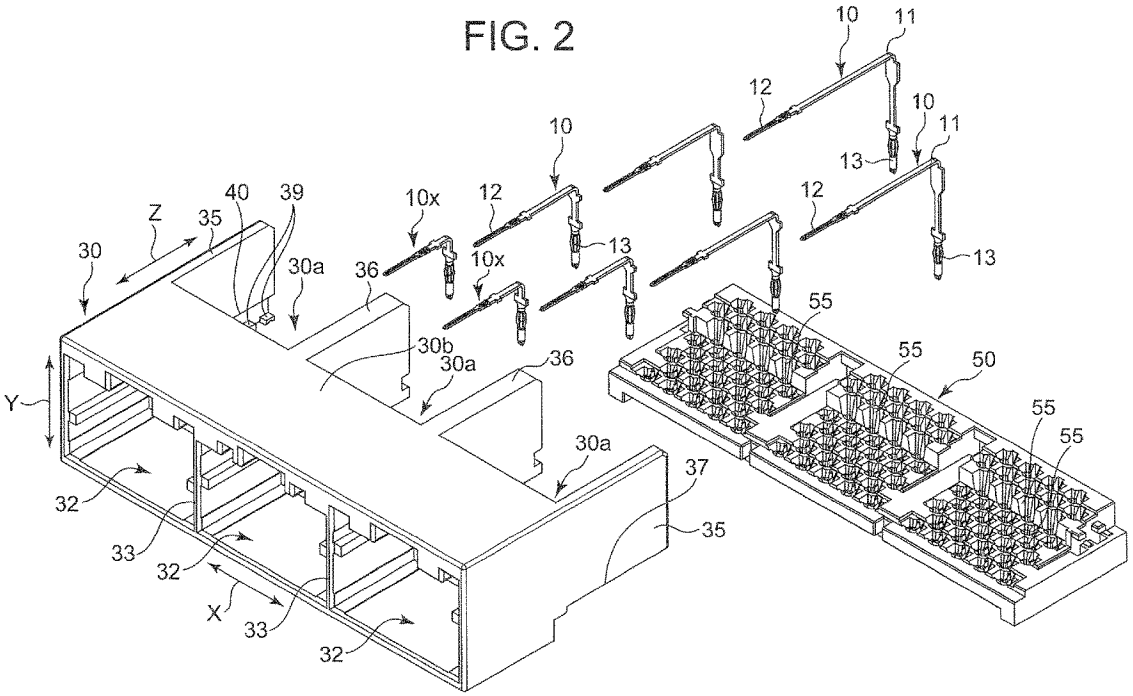
FIG. 2 is a partial exploded perspective view of the electrical connector shown in FIG. 1.

As shown in FIG. 1 and FIG. 2, an electrical connector 100 in this Embodiment includes: a plurality of L-shaped conductive terminals 10 and 10*x*; a housing 30 holding the plurality of conductive terminals 10 and 10*x* in an aligned state; and an alignment member 50 engaged with the housing 30. Hereinafter, in FIG. 1, the followings are assumed. That is, arrow X indicates a right and left direction (horizontal direction); arrow Y indicates a vertical direction; and arrow Z indicates a back and forth direction (backward and forward direction).

Figure 3:
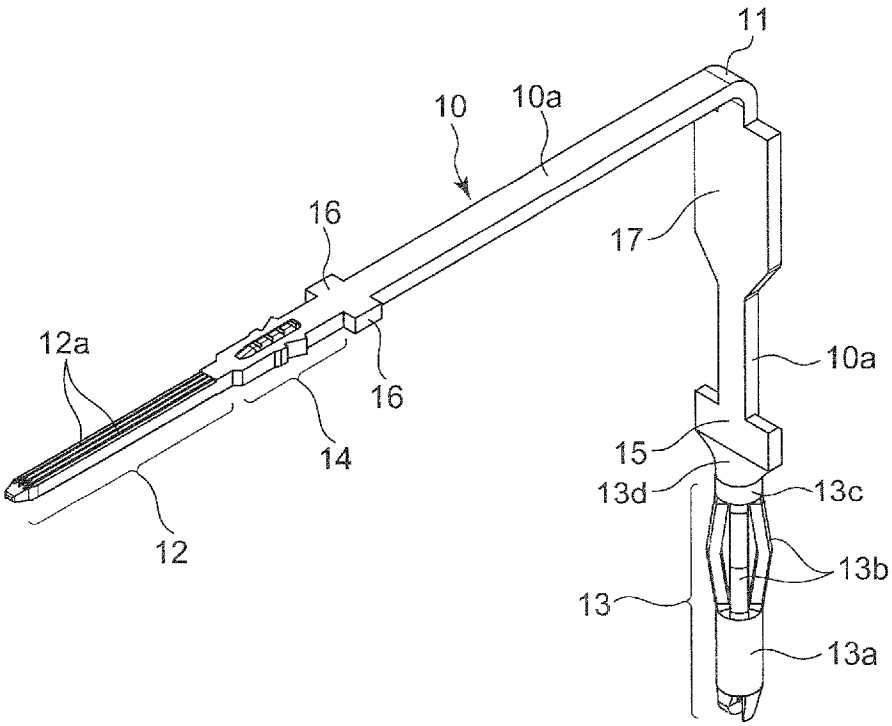
FIG. 3 is a perspective view of a conductive terminal shown in FIG. 2.

As shown in FIG. 3, each of the conductive terminals 10 includes: a connector-side connecting part 12; a substrate-side connecting part 13; and an L-shaped bent part 11 between the connector-side connecting part 12 and the substrate-side connecting part 13.

The connector-side connecting part 12 is substantially in a shape of a square pole, and a plurality of grooves 12*a* in a longitudinal direction of the connector-side connecting part 12 are formed on two opposing surfaces thereof. A plurality of engaging portions 14 to be inserted into a plurality of terminal-holding holes 31, which will be mentioned below, of the housing 30 and a wide area 16 for securing a pressing position upon press-inserting the conductive terminal 10 into the housing 30, are formed between the connector-side connecting part 12 and the bent part 11.

Between the bent part 11 and the substrate-side connecting part 13 of the conductive terminal 10, a projecting shoulder part 15 widened from a body part 10*a* to be in an inverted T-shape is provided near the substrate-side connecting part 13, and a terminal holder 17 widened from the body part 10*a* to be substantially in a shape of a home base is provided near the bent part 11.

In the conductive terminal 10, a distal end 13*a* of the substrate-side connecting part 13 is substantially in a shape of a cylinder having a C-shaped cross-section. A contact portion 13*b* including a press-fit mechanism capable of elastically expanding/contracting, is provided between the distal end 13*a* and the projecting shoulder part 15. A continuously-provided portion 13*c* with the C-shaped cross section, and a guide section 13*d* with a curved surface smoothly connecting the continuously-provided portion 13*c* to the projecting shoulder part 15, are provided between the contact portion 13*b* and the projecting shoulder part 15.

As shown in FIG. 2, the plurality of conductive terminals 10 and 10*x* are attached to different positions of the housing 30, and have differences in spans and positions of the bent parts 11 caused by the different positions. However, the conductive terminals 10 and 10*x* have basically the same form and the same function as those of the conductive terminal 10 shown in FIG. 3. Accordingly, explanation with respect to the other conductive terminals 10 is omitted. In FIG. 2, it should be noted that the terminal holder 17 is not provided in the conductive terminals 10*x* with the shortest length and the shortest length but one.

Figure 4:
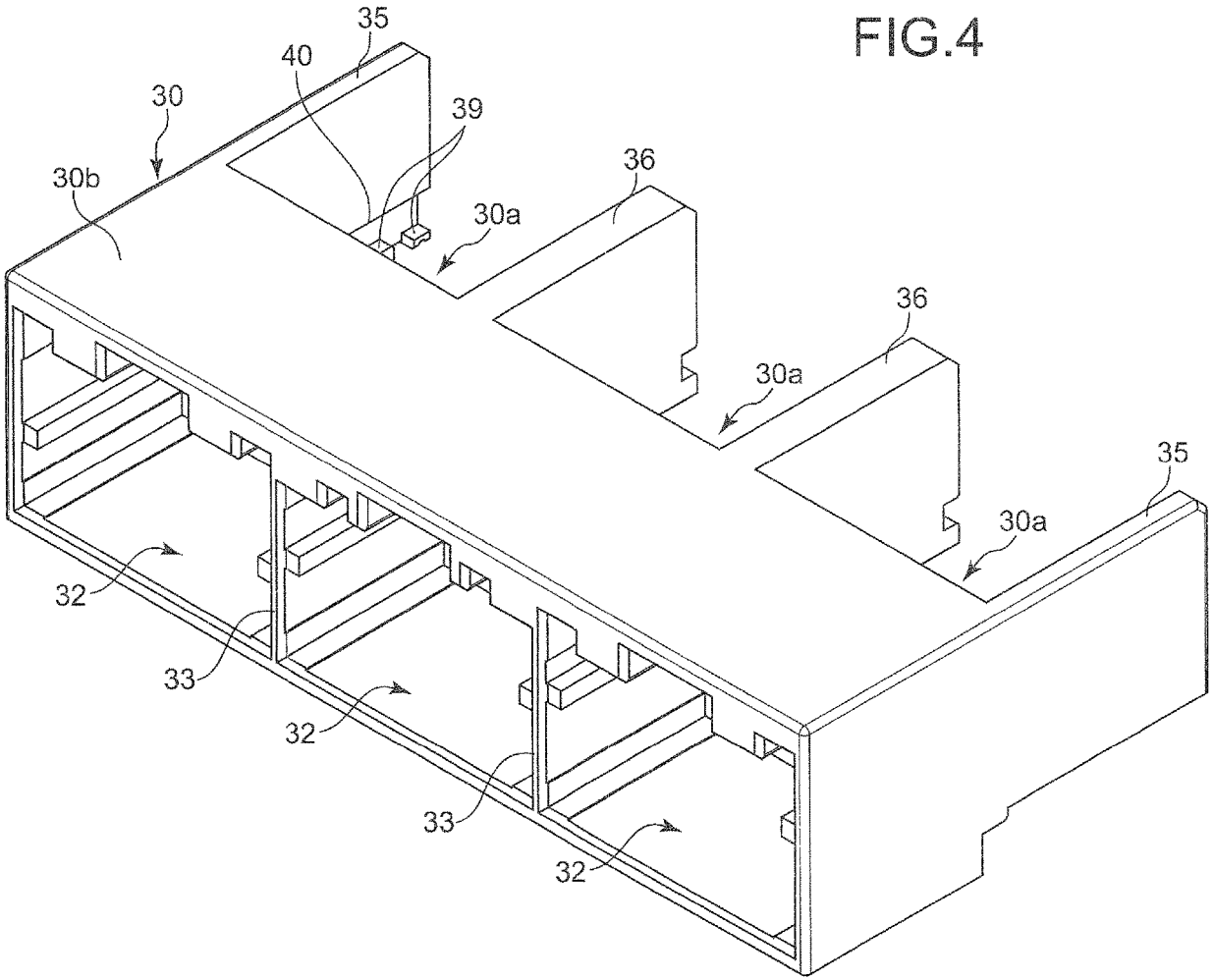
FIG. 4 is an enlarged perspective view of a housing shown in FIG. 2.
Figure 5:
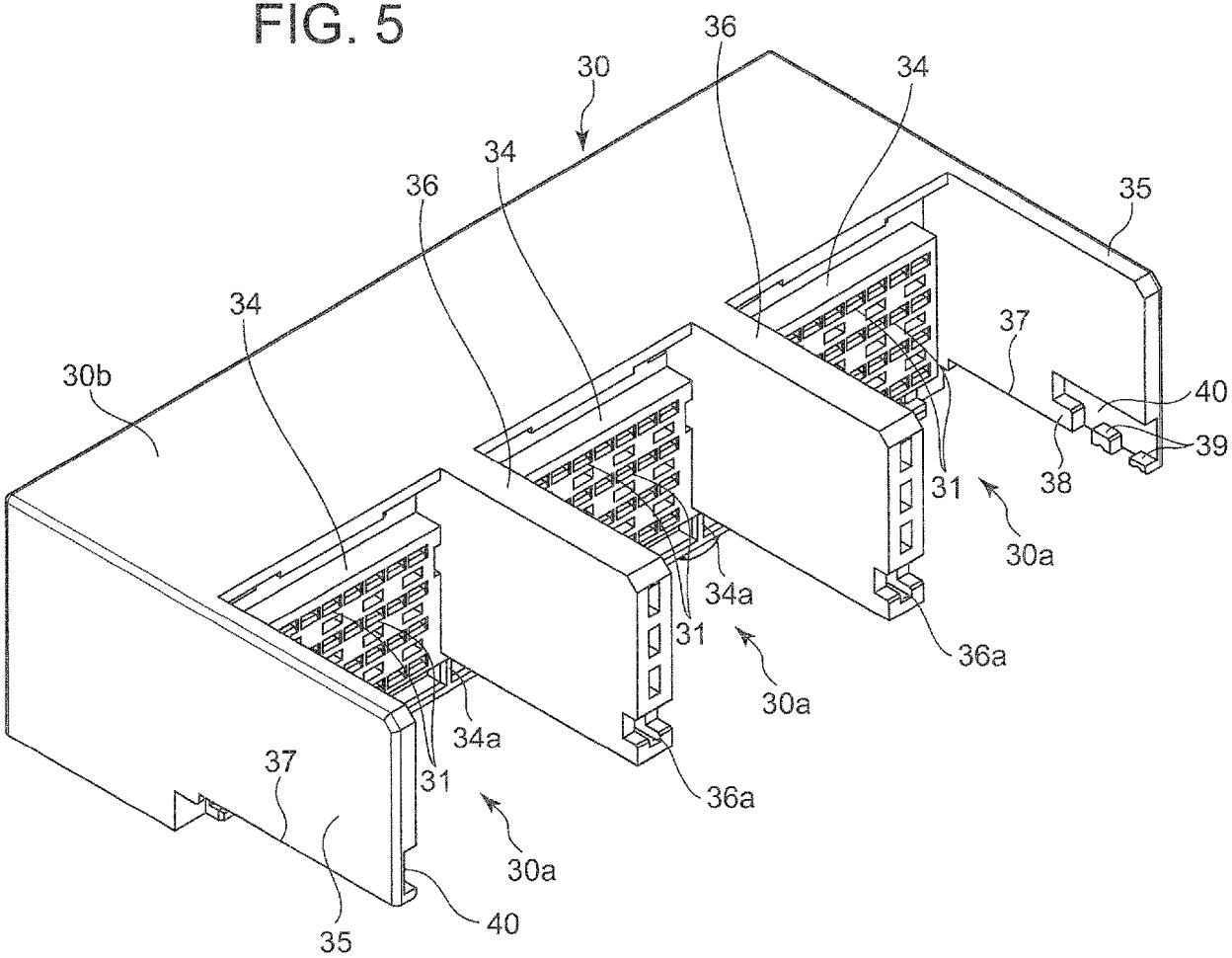
FIG. 5 is a perspective view of the housing shown in FIG. 4.

As shown in FIG. 2, FIG. 4, and FIG. 5, a plurality of openings 32 for fitting a mating connector (not shown) therein, are divided by partitions 33 and are provided on a front surface of the housing 30. And, a screen 34 passing through the housing 30, is provided behind the openings 32. Outer side walls 35 and 35 projecting from the screen 34 to the back face side, are provided at both sides of the housing 30.

A plurality of inner side walls 36 and 36 projecting from the screen 34 to the back face side, are provided in an area between the outer side walls 35 and 35 opposing to each other. The inner side walls 36 and 36 are formed so as to have the same interval as those of the partitions 33.

In the housing 30, openings 30*a* near lower edges of the outer side walls 35 and 35, are arranged between the outer side walls 35 and 35 opposing to each other. The openings 30*a* correspond to openings being used for connecting a circuit substrate. The openings 30*a* are opened so as to expose the substrate-side connecting parts 13 of the conductive terminals 10 and 10*x* to the outside.

The plurality of terminal-holding holes 31 are vertically and horizontally opened through the screen 34 according to a predetermined interval. In a direction from the back face to the front face of the screen 34, the connector-side connecting parts 12 of the conductive terminals 10 and 10*x* (shown in FIG. 2 and FIG. 3) are inserted into the terminal-holding holes 31, and the engaging portions 14 engage with inner surfaces of the terminal-holding holes 31. And then, the conductive terminals 10 are held by the housing 30.

Near the back face of the housing 30, notched portions 37 for fitting side pieces 51 of the alignment member 50 therein, are opened at lower edges of the outer side walls 35 and 35. Inside of the lower edges of the outer side walls 35 and 35 of the housing 30, recessed portions 40 and lock parts 38 and 39 are provided. A plurality of lock parts 52 and 53 provided with upper portions of the side pieces 51 of the alignment member 50, are fitted into the recessed portions 40. And, the lock parts 52 and 53 engage with the lock parts 38 and 39.

As shown in FIG. 2, Figs. from 6 to 13, the alignment member 50 is a plate-like member attached to the openings 30*a* of the housing 30 so as to close the same. A plurality of through holes 55 for inserting the substrate-side connecting parts 13 of the conductive terminals 10 and 10*x* therein, are opened through the alignment member 50 in a thickness direction (See, arrow Y.) thereof. The arrangement of the plurality of through holes 55 is set up so as to have the same phase as that of the arrangement of the plurality of conductive terminals 10 and 10*x* attached to the terminal-holding holes 31 of the housing 30.

Recessed portions 54 are provided at front edge portions of the alignment member 50. A plurality of projections 34*a* are provided with lower edge portions of the screen 34 of the housing 30. The projections 34*a* can fit into the recessed portions 54. The plurality of projections 34*a* are provided at lower portions of a border between the inner side walls 36 and 36 and the screen 34. The plurality of projections 34*a* have the same interval as that of the inner side walls 36 and 36. A bridge part 56 is provided with back edge portions of the alignment member 50. The bridge part 56 can fit into recessed parts 36*a* provided at lower edge portions of the inner side walls 36 of the housing 30.

Figure 6:
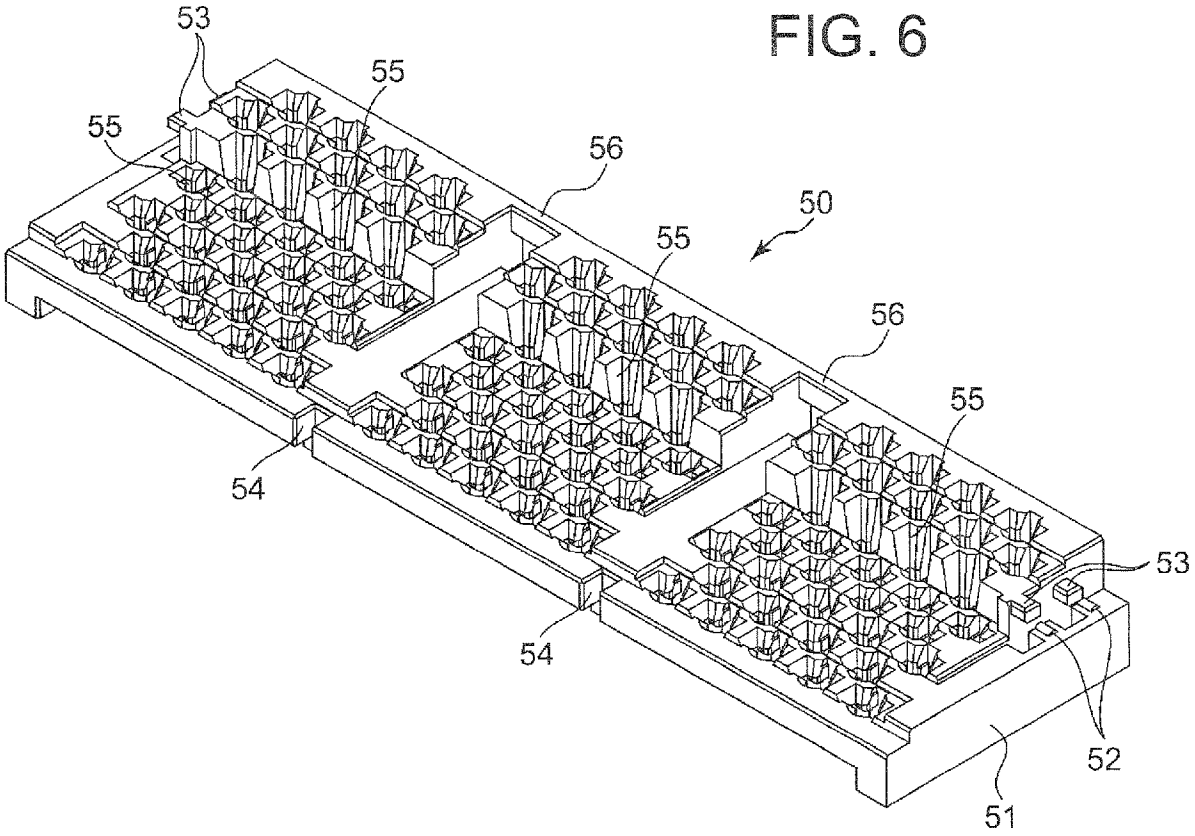
FIG. 6 is an enlarged perspective view of an alignment member shown in FIG. 2.
Figure 7:
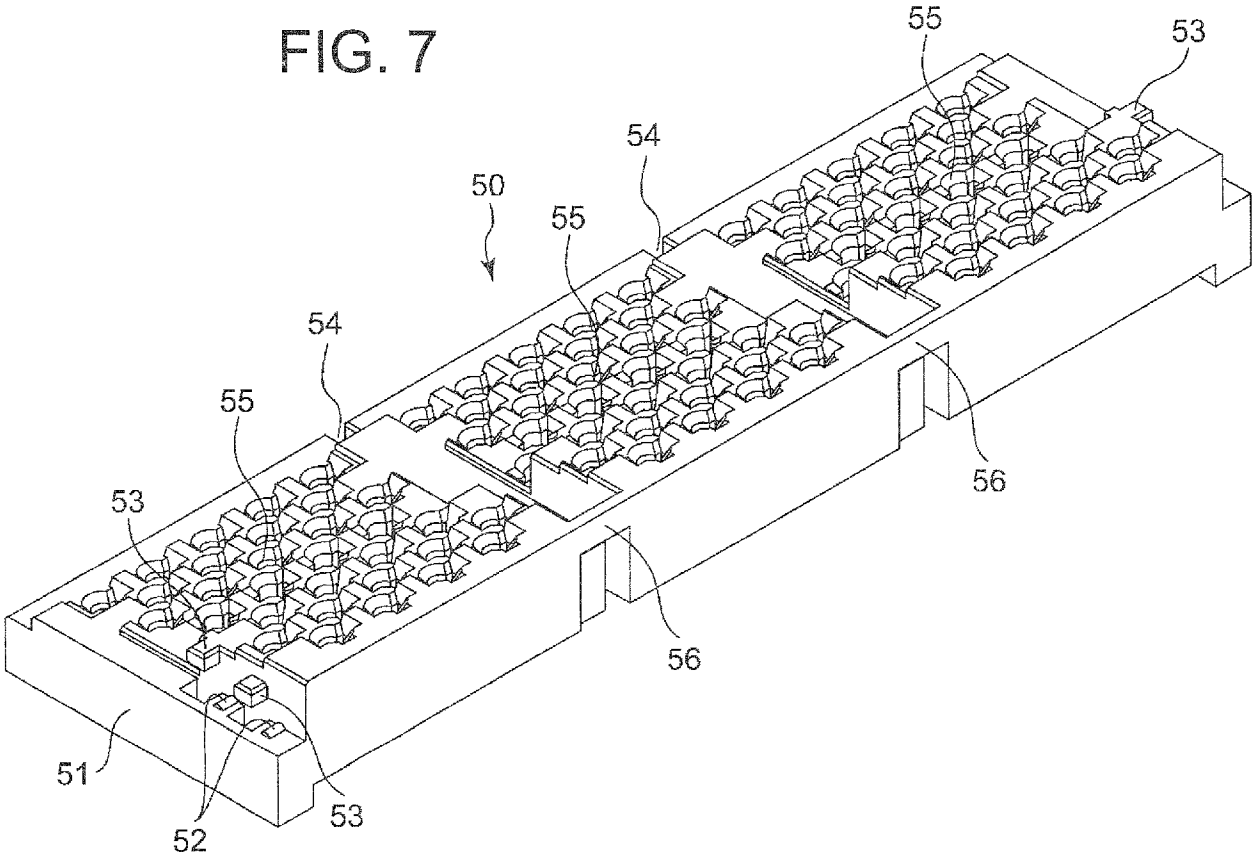
FIG. 7 is a perspective view of the alignment member shown in FIG. 6.
Figure 10:
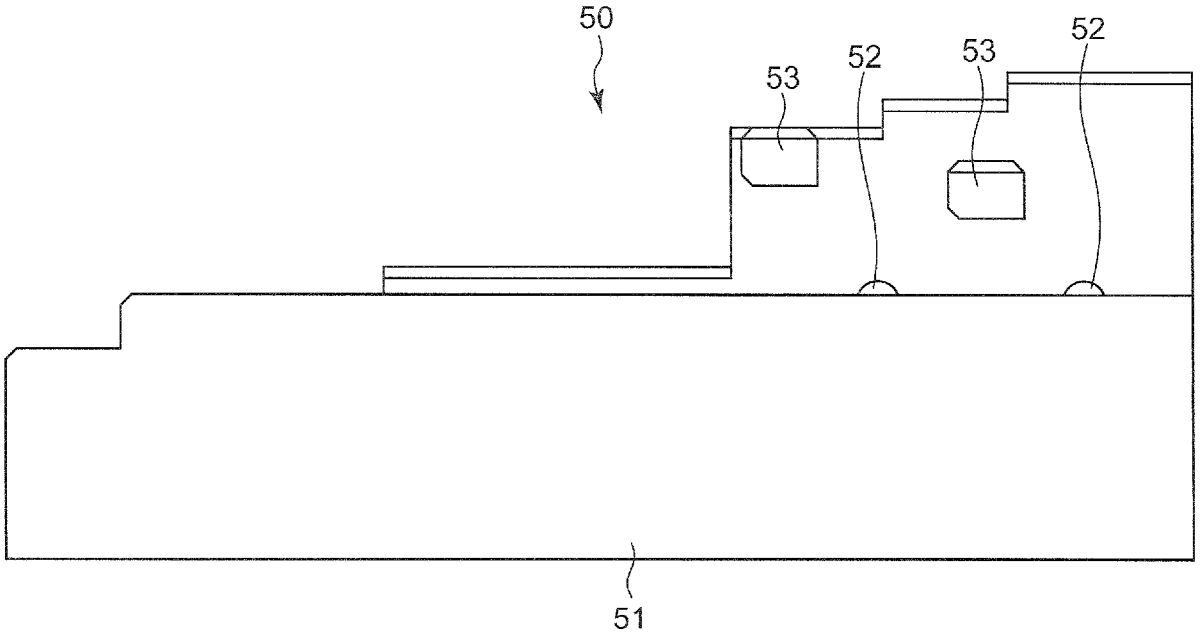
FIG. 10 is a right side view of the alignment member shown in FIG. 6.

As shown in FIG. 6, FIG. 7, and FIG. 10, an upper surface of the alignment member 50 is in a staircase shape that becomes higher from the front edge portion to the back edge portion thereof. Each step is set up to have a height corresponding to vertical positions of the terminal holders 17 of the plurality of conductive terminals 10 held by the housing 30.

Figure 11:
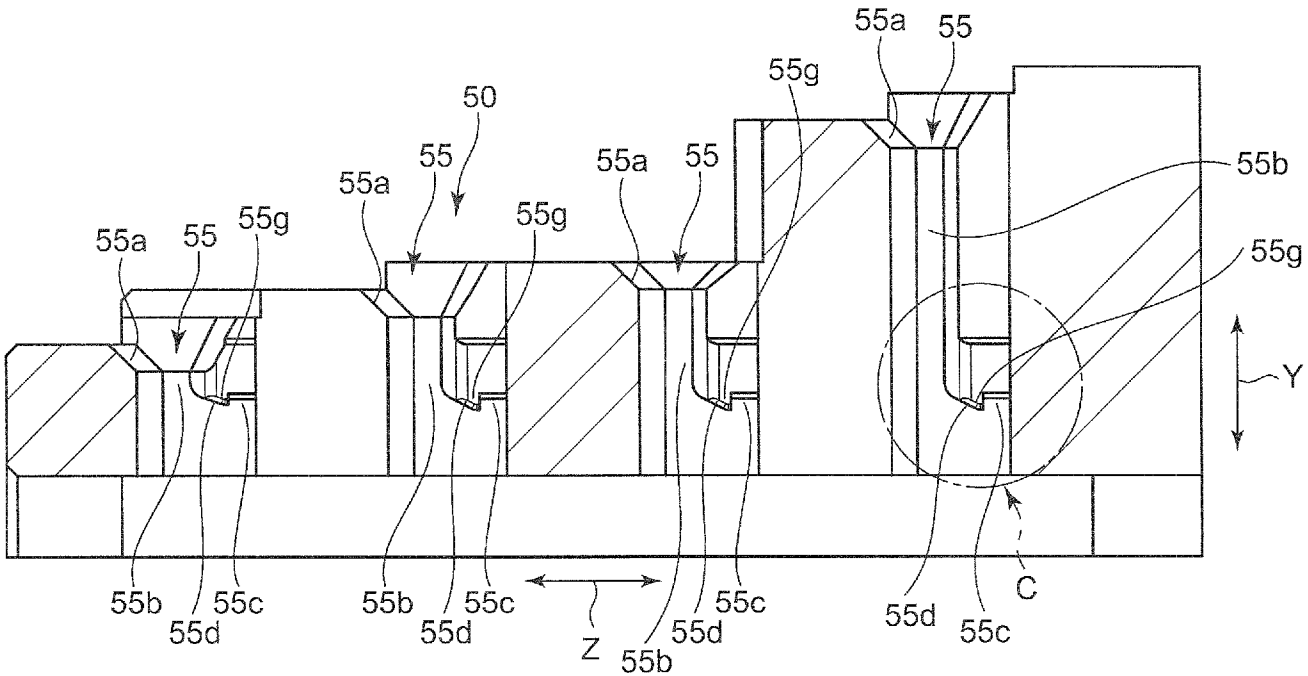
FIG. 11 is a cross-sectional view by A-A line in FIG. 8.

As shown in FIG. 11, each of the plurality of through holes 55 opened through the alignment member 50, includes the followings. That is, a mortar-like guide section 55*a* is opened toward the upper surface of the alignment member 50. A penetrating part 55*b* penetrates from a lower edge portion of the guide section 55*a* toward the lower surface of the alignment member 50. And, a recessed holding part 55*c* is formed so as to be recessed toward the back of the alignment member 50 within the penetrating part 55*b*. Between an inner peripheral surface of the penetrating part 55*b* and the recessed holding part 55*c*, a suspended part 55*g* having a guide surface 55*d* is provided.

Figure 8:
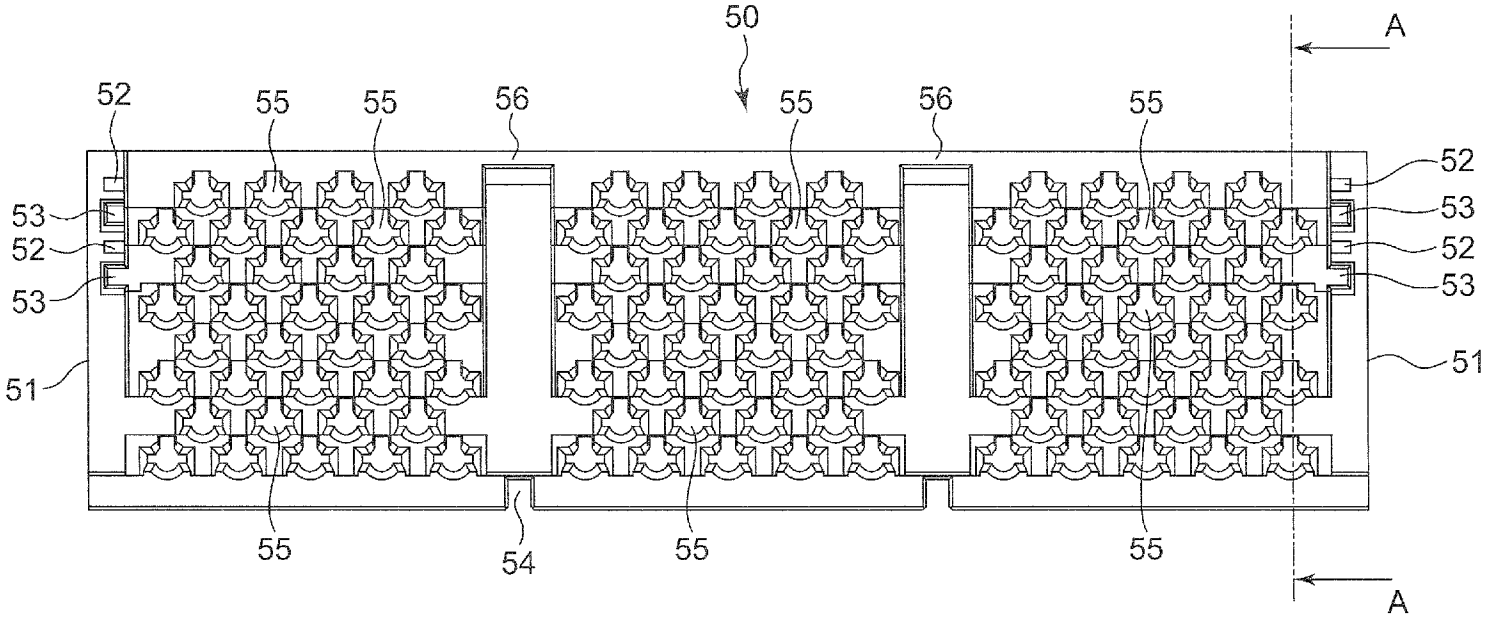
FIG. 8 is a plan view of the alignment member shown in FIG. 6.
Figure 9:
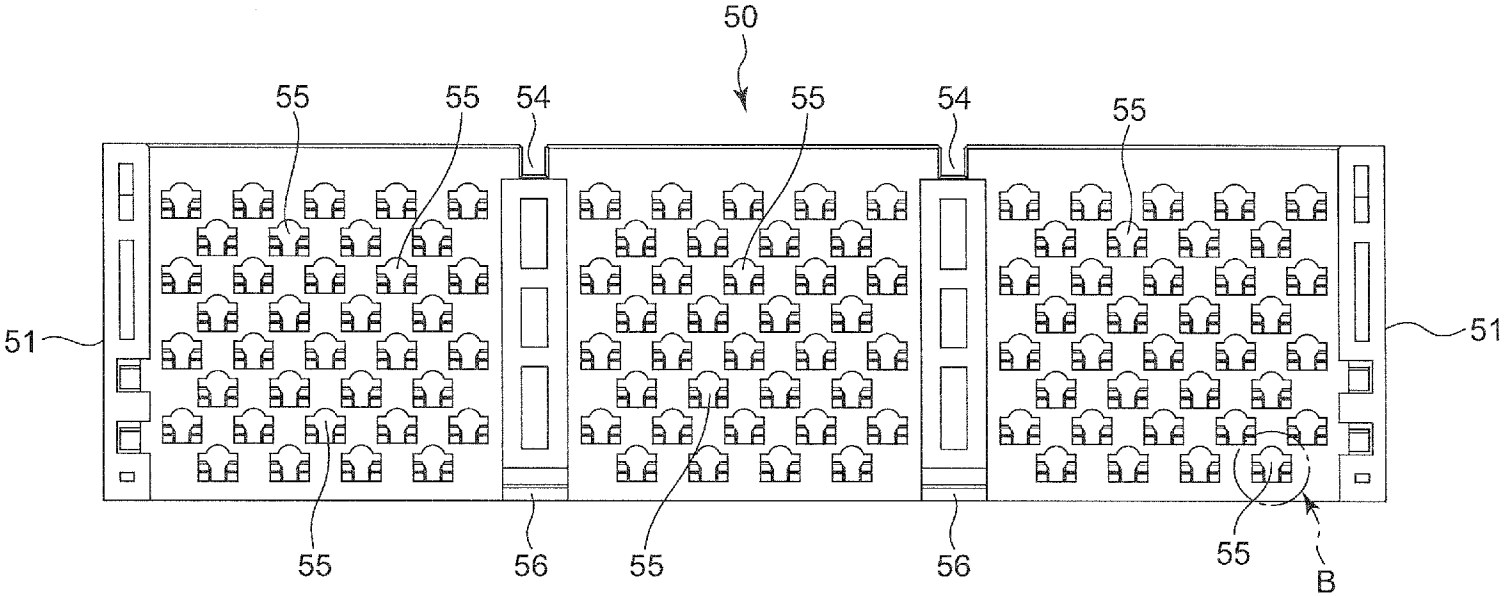
FIG. 9 is a bottom view of the alignment member shown in FIG. 6.
Figure 12:
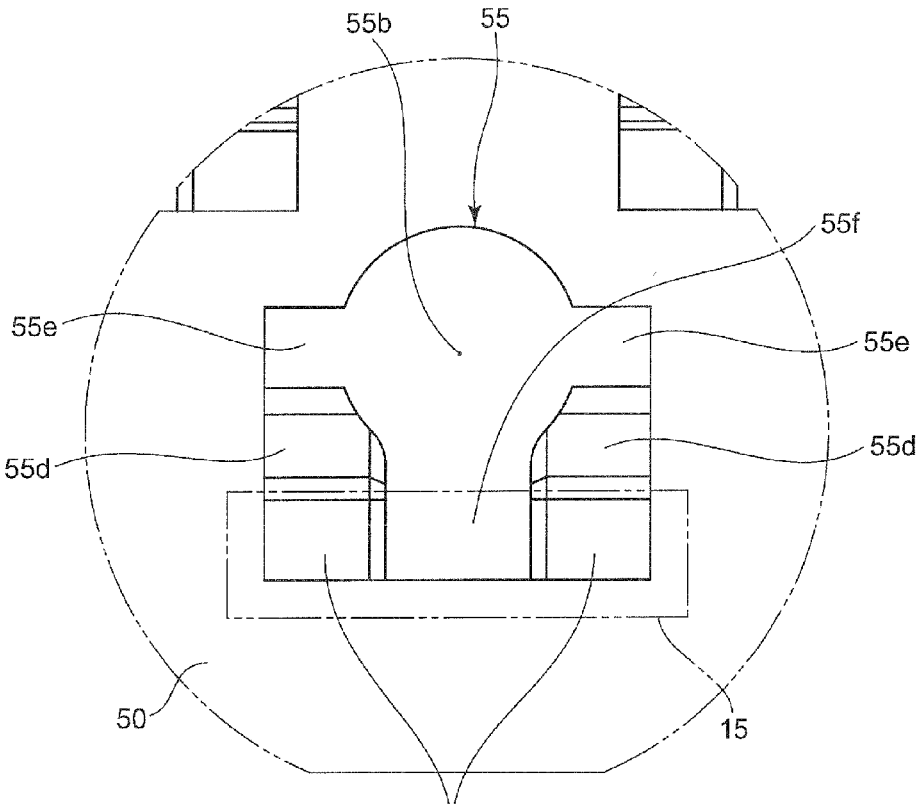
FIG. 12 is an enlarged view by arrow B in FIG. 9.

As shown in FIG. 8, FIG. 9, and FIG. 12, a pair of shoulder part inserting grooves 55*e* are formed in the through holes 55 of the alignment member 50. The shoulder part inserting grooves 55*e* radially expand from the inner peripheral surface of the penetrating part 55*b*, and oppose to each other in 180 degrees. There is provided a moving path 55*f* spreading from the penetrating part 55*b* toward the recessed holding part 55*c*.

Next, referring to Figs. from 14 to 18, processes of assembling the electrical connector 100 shown in FIG. 1 will now be explained.

Figure 14:
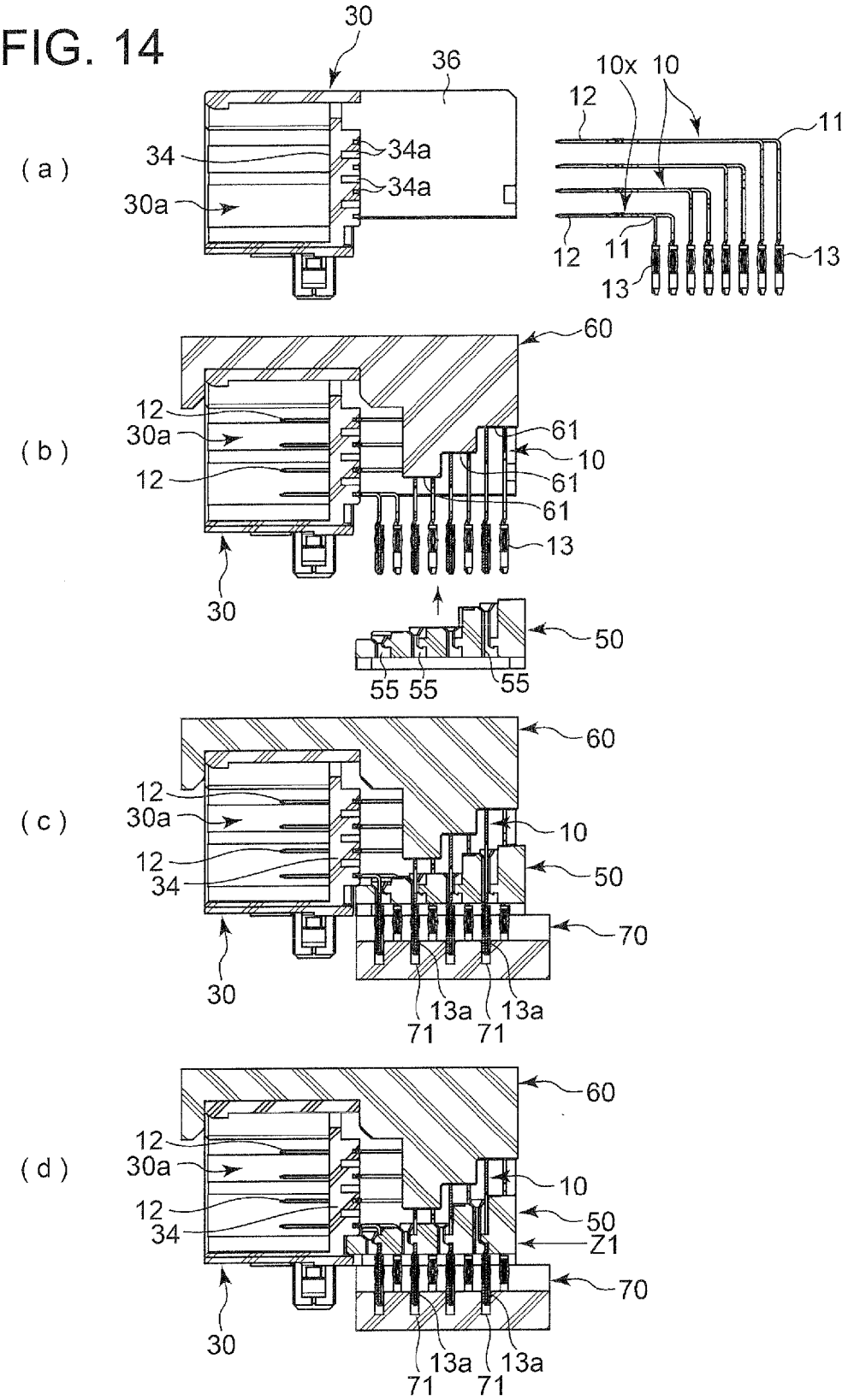
FIG. 14 is a chart showing a part of assembly processes of the electrical connector shown in FIG. 1.

As shown in FIG. 14 (*a*), inserting the connector-side connecting parts 12 of the plurality of conductive terminals 10 and 10*x* of into the plurality of terminal-holding holes 31 opened through the screen 34 of the housing 30 from the back surface to the front surface of the screen 34, respectively, causes to press-insert the engaging portions 14 of the conductive terminals 10 and 10*x* into the terminal-holding holes 31 to be held thereby.

Next, as shown in FIG. 14 (*b*), a jig 60 is attached onto an upper surface of the housing 30. A stepped contact surface 61 is provided on a lower surface of the jig 60. When the alignment member 50 is attached from the lower surface of the housing 30 toward the substrate-side connecting parts 13 of the conductive terminals 10 and 10*x*, the contact surface 61 of the jig 60 and the terminal holder 17 of the conductive terminal 10 abut to each other. Thereby, the alignment member 50 can be surely attached.

Next, as shown in FIG. 14 (*c*), the substrate-side connecting parts 13 of the plurality of conductive terminals 10 and 10*x* penetrate the through holes 55 of the alignment member 50, and project downward from a lower surface of the alignment member 50. And then, a jig 70 is attached toward the substrate-side connecting parts 13. The jig 70 includes a plurality of opened holding recessed parts 71 into which distal ends 13*a* of the substrate-side connecting parts 13 of the plurality of conductive terminals 10 and 10*x* can be inserted, respectively.

Figure 15:
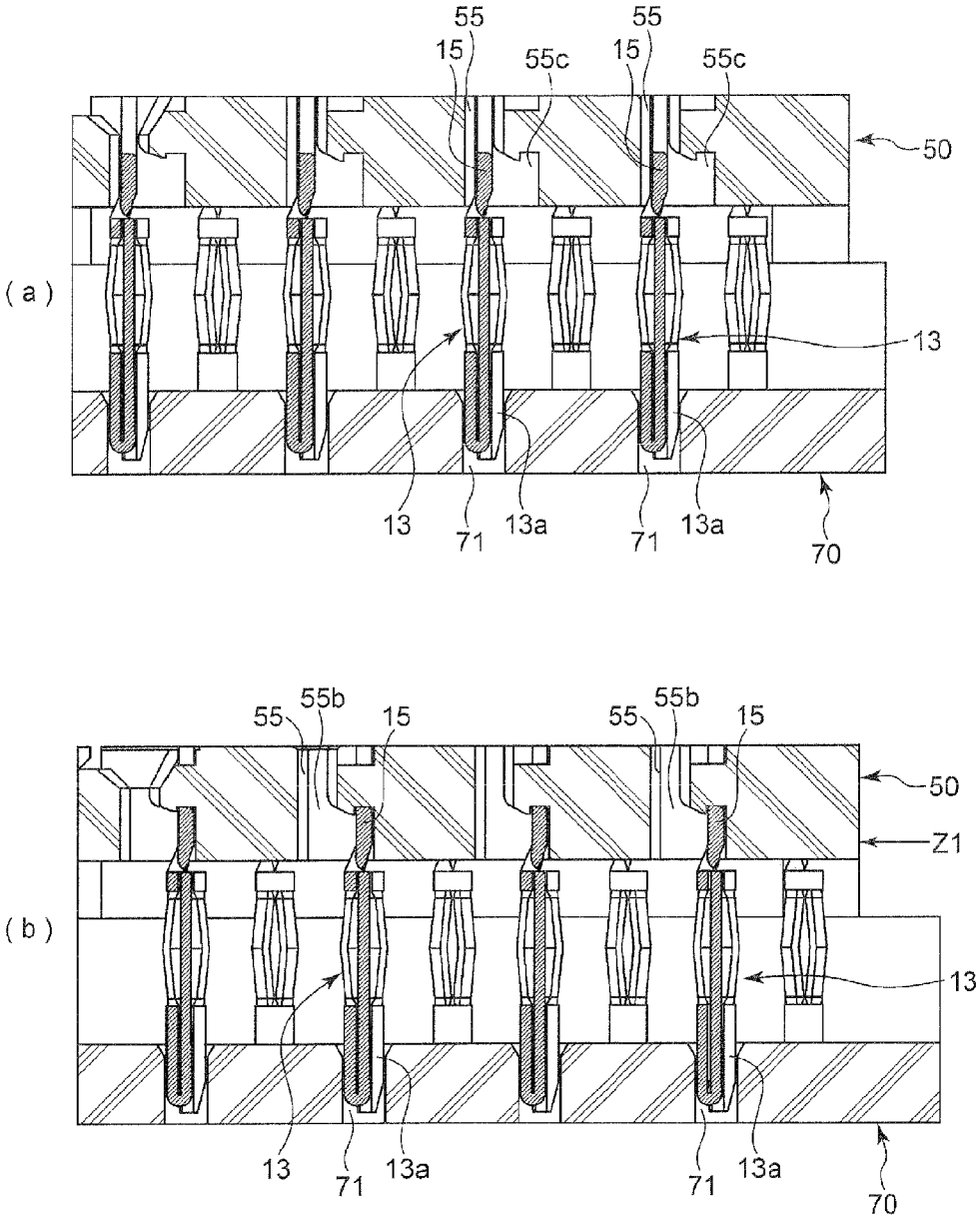
FIG. 15 is an enlarged chart showing the part of the assembly processes shown in FIG. 14.

Accordingly, as shown in FIG. 14 (*c*) and FIG. 15 (*a*), when the jig 70 is attached in a state where the distal ends 13*a* of the plurality of conductive terminals 10 and 10*x* have been inserted into the holding recessed parts 71, the substrate-side connecting parts 13 of the conductive terminals 10 and 10*x* are held not to move even if external force acts thereto.

After that, while the jigs 60 and 70 have been held as shown in FIG. 14 (*d*) and FIG. 15 (*b*), upon applying external force in a direction of arrow Z1 from the back surface to the front surface of the alignment member 50, the alignment member 50 horizontally slides toward the screen 34 of the housing 30. The projecting shoulder part 15, which has been located in the penetrating part 55*b* of the through hole 55 of the alignment member 50, moves to fit into the recessed holding part 55*c* through processes mentioned below referring to FIG. 16.

When the alignment member 50 horizontally slides, the contact surface 61 of the jig 60 guides the terminal holder 17 of the conductive terminal 10, and the height of the projecting shoulder part 15 can be set at a regular position.

Figure 16:
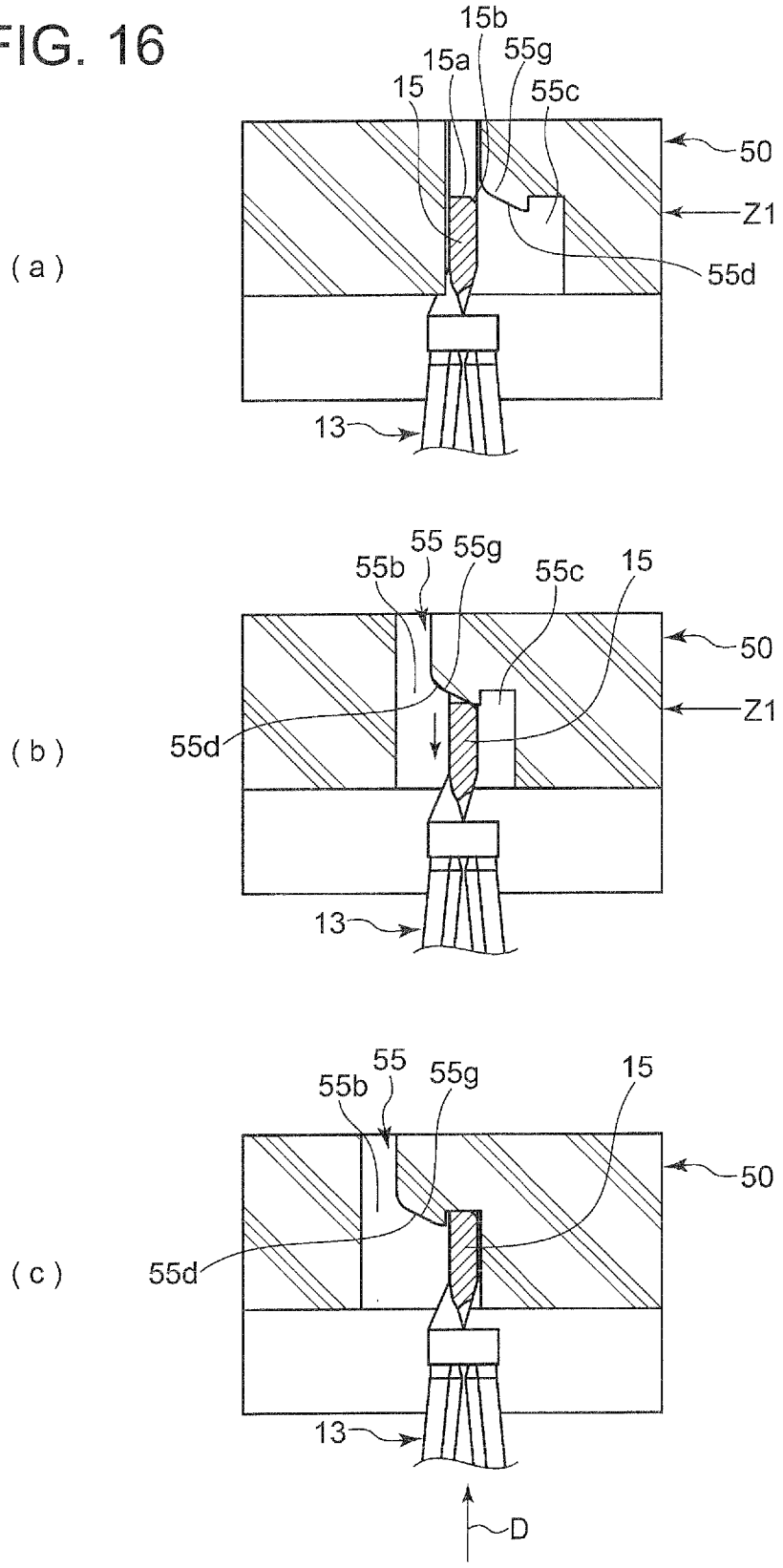
FIG. 16 is a cross-sectional view showing operation of a projecting shoulder part of a conductive terminal in the assembly processes shown in FIG. 14.

More concretely, upon applying the external force in the direction of arrow Z1 to the alignment member 50 in a state of FIG. 16 (*a*), an inclined plane 15*b* formed on a back edge of an upper surface 15*a* of the projecting shoulder part 15 of the conductive terminal 10, abuts onto the guide surface 55*d* of the suspended part 55*g* as shown in FIG. 16 (*b*).

The inclined plane 15*b* and the guide surface 55*d* incline in the same direction. When the external force in the direction of arrow Z1 is further applied, the guide surface 55*d* slides to run over the upper surface 15*a* along the inclined plane 15*b*, whereby the projecting shoulder part 15 is pressed downward. At this time, a horizontal portion between the wide area 16 and the bent part 11 of the body part 10*a* (See, FIG. 3.) of the conductive terminal 10, is elastically deformed to press the projecting shoulder part 15 downward.

Figure 17:
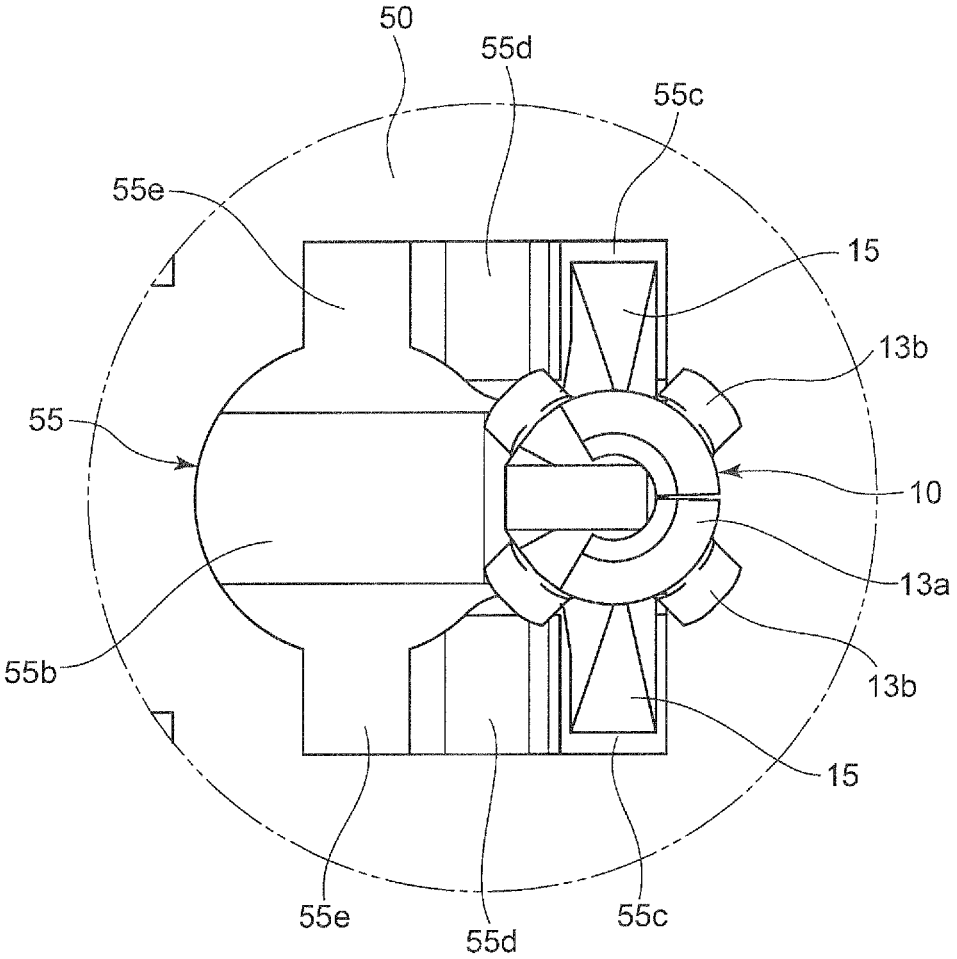
FIG. 17 is a view by arrow D in FIG. 16.

After that, when the rear edges of the guide surfaces 55*d* have passed the front edge portion of the upper surface 15*a* of the projecting shoulder part 15, downward pressing force against the projecting shoulder part 15 is released. Then, as shown in FIG. 16 (*c*) and FIG. 17, the projecting shoulder part 15 rises toward the original position thereof to fit into the recessed holding part 55*c*. In this way, attaching the alignment member 50 onto the housing 30 has been completed.

Figure 18:
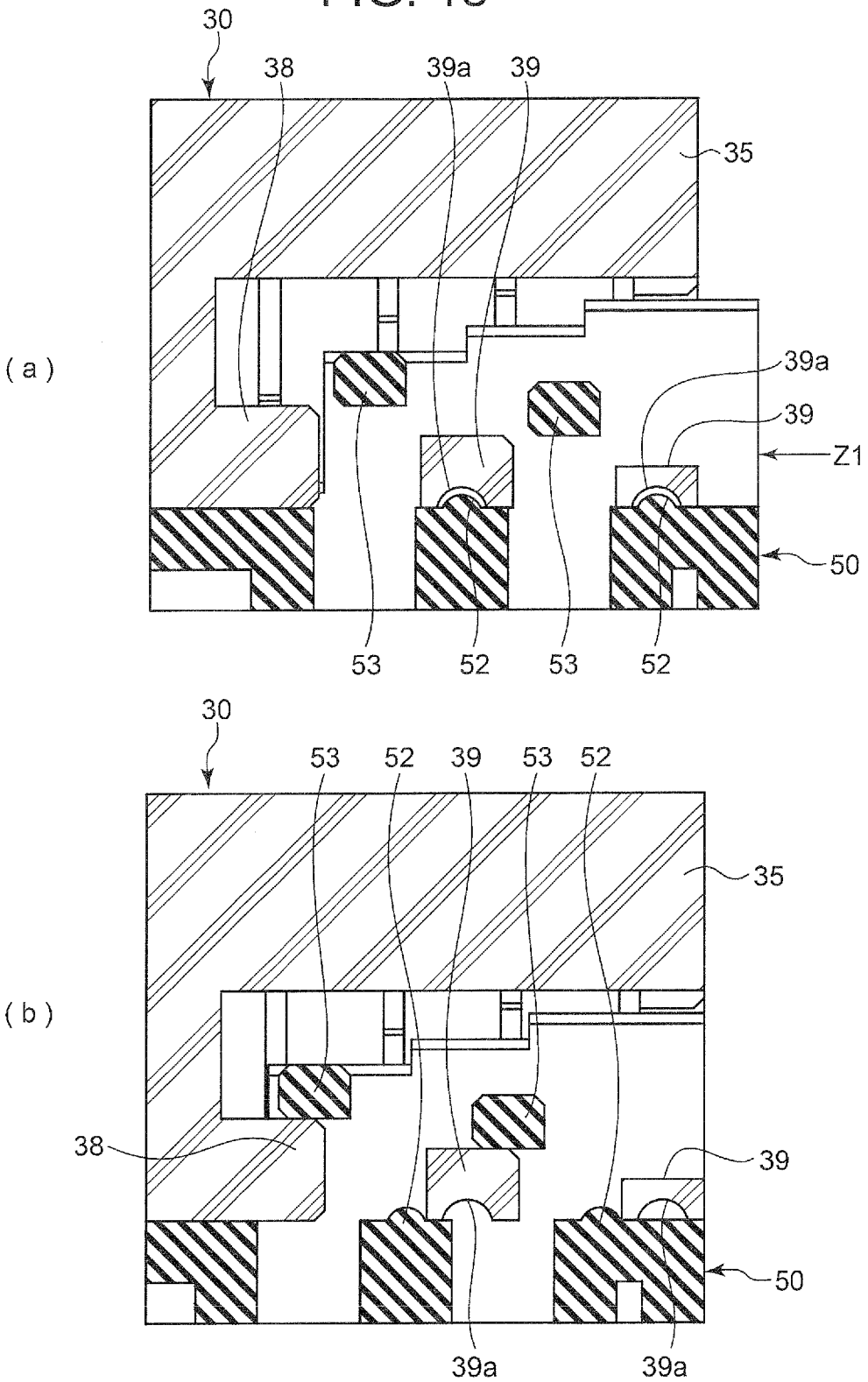
FIG. 18 is a cross-sectional view showing a locked state of the alignment member and the housing in the assembly processes shown in FIG. 14.

When the alignment member 50 is going to be attached to the housing 30, the alignment member 50 is locked to the housing 30 between the side pieces 51 of the alignment member 50 and the outer side walls 35 of the housing 30 through processes as shown in FIG. 18.

More concretely, when the alignment member 50 is in the state of FIG. 14 (*c*) with respect to the housing 30, the side pieces 51 of the alignment member 50 and the outer side walls 35 of the housing 30 are in the state of FIG. 18 (*a*). That is, as shown in FIG. 18 (*a*), the lock parts 52 in a semi-cylindrical shape provided with both sides of the alignment member 50 are fitted into recessed grooves 39*a* formed on lower surfaces of the lock parts 39. The lock parts 39 are provided with the recessed portions 40 formed on the outer side walls 35 of the housing 30.

Next, as shown in FIG. 18 (*b*), when the external force in the direction of arrow Z1 is applied to the alignment member 50, the two lock parts 52 are fitted to front surface sides of the lock parts 39, respectively. The left lock part 53 among the two lock parts 53 abuts onto the upper surface of the lock part 38, and the right lock part 53 of the same also abuts onto the upper surface of the lock part 39. Passing through processes as shown in FIG. 18 enables to lock the side pieces 51 of the alignment member 50 and the outer side walls 35 of the housing 30 so as not to easily separate with each other.

Next, referring to Figs. from 19 to 21, processes of attaching a circuit substrate 200 to the electrical connector 100 will now be explained.

Figure 19:
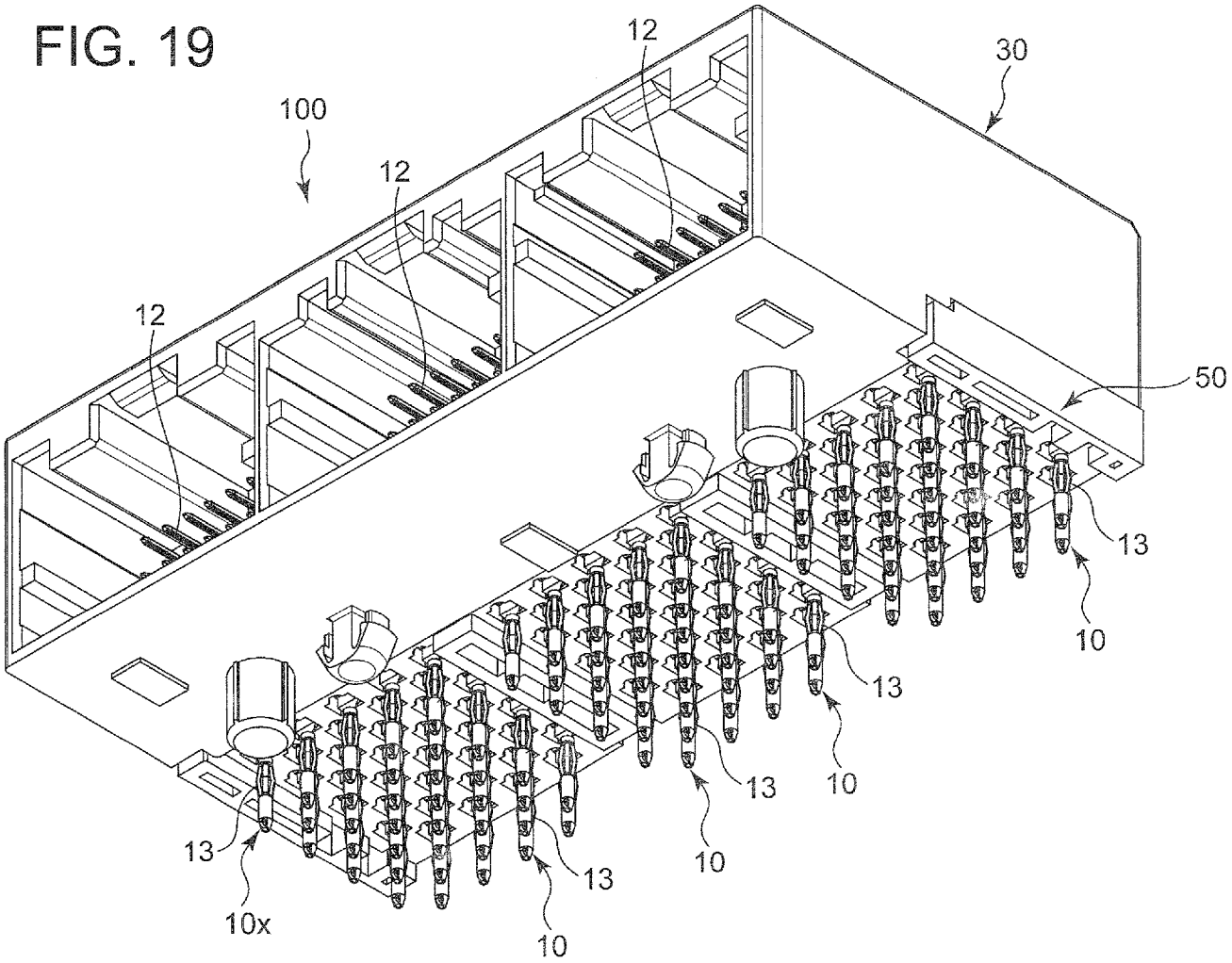
FIG. 19 is a perspective view of a finished electrical connector.
Figure 20:
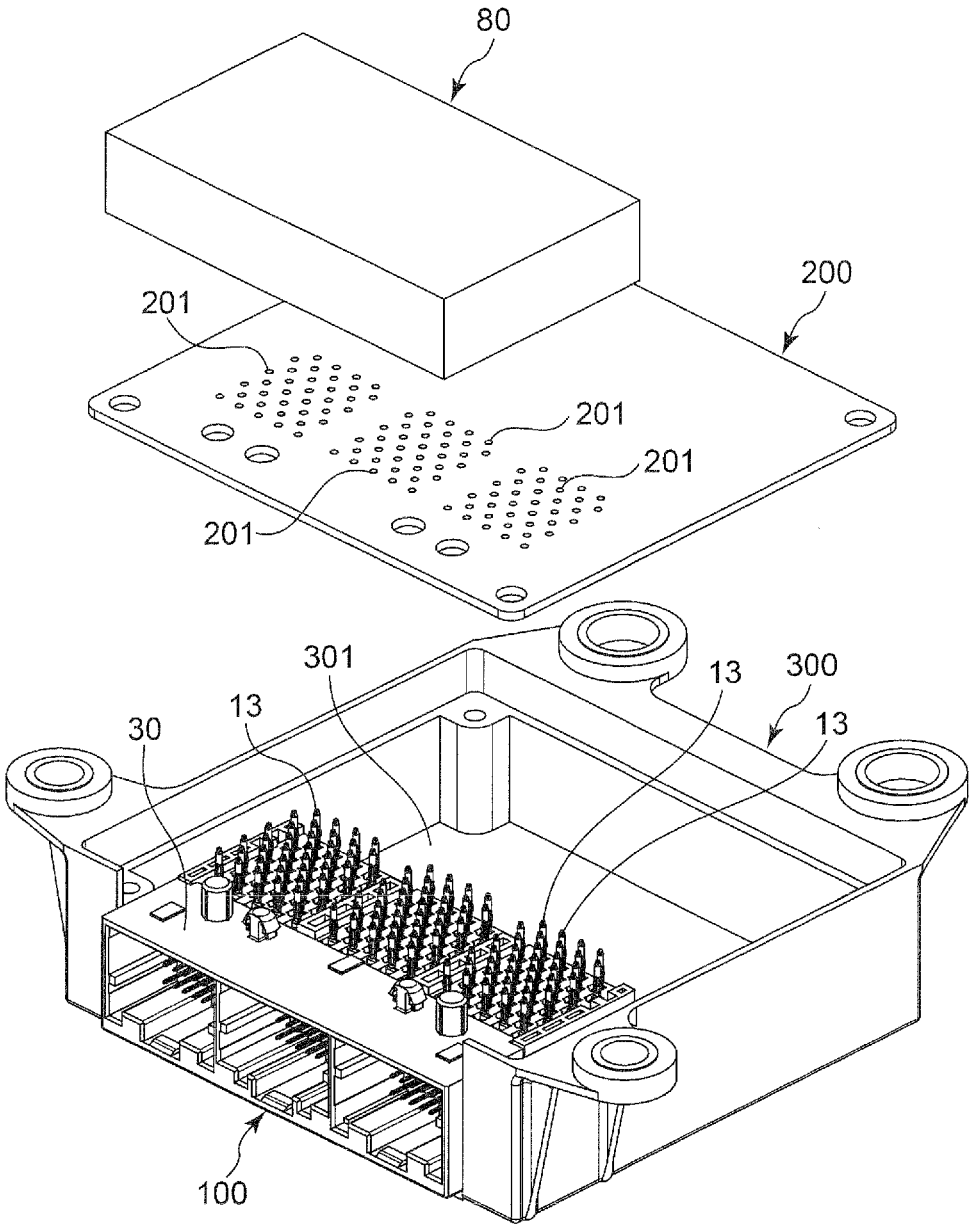
FIG. 20 is a perspective view a state before attaching a circuit substrate to the electrical connector shown in FIG. 19.
Figure 21:
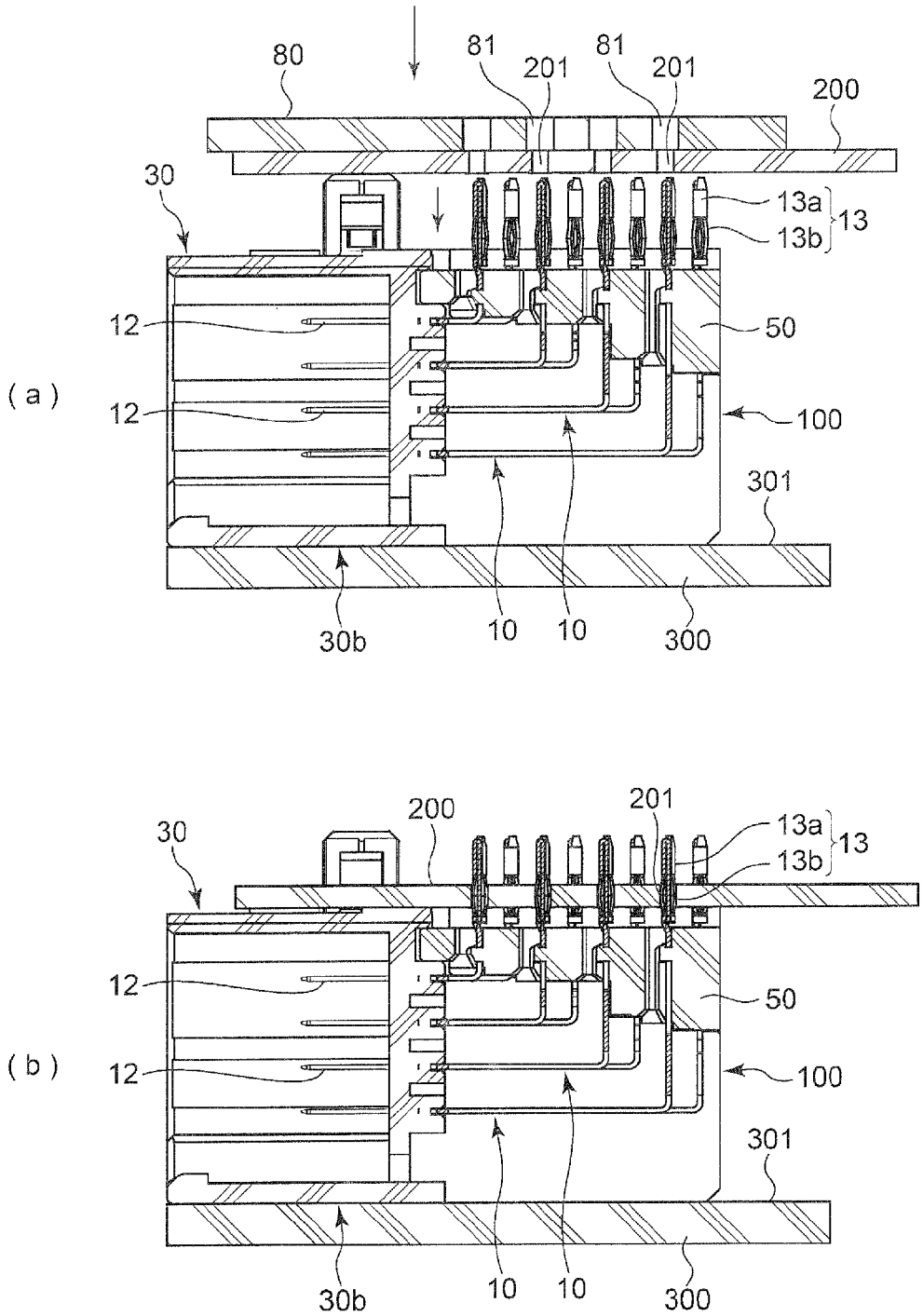
FIG. 21 is a cross-sectional view showing the process of attaching the circuit substrate to the electrical connector shown in FIG. 19.

As shown in FIG. 19, in the finished electrical connector 100, the substrate-side connecting parts 13 of the plurality of conductive terminals 10 and 10*x*, project downward from the lower surface of the alignment member 50. Upon attaching the circuit substrate 200 to the electrical connector 100, as shown in FIG. 20 and FIG. 21 (*a*), an upper surface 30*b* of the housing 30 of the electrical connector 100 is set up in a state where the upper surface 30*b* abuts onto an inner surface 301 of a housing 300.

The lower surface of the alignment member 50 exposes to the outside. And then, the circuit substrate 200 and a substrate press fitting jig 80, are arranged onto the lower surface of the alignment member 50. A plurality of through holes 201 have been opened through the circuit substrate 200 in the same arrangement as that of the substrate-side connecting parts 13 of the plurality of conductive terminals 10 and 10*x*. A plurality of holes 81 (See, FIG. 21.) of the same arrangement as the plurality of through holes 201 have been also opened through the substrate press fitting jig 80.

After that, pressing the circuit substrate 200 toward the electrical connector 100 using the substrate press fitting jig 80, causes the plurality of substrate-side connecting parts 13 to be inserted into the through holes 201 of the circuit substrate 200, respectively. When the substrate press fitting jig 80 is removed from the circuit substrate 200 after inserting the substrate-side connecting parts 13 into the through holes 201 has been completed, as shown in FIG. 21 (*b*), the contact portions 13*b* of the substrate-side connecting parts 13 are kept to be held within the through holes 201. In this way, attaching the circuit substrate 200 to the electrical connector 100 is finished.

The electric connector 100 includes the alignment member 50 engaged by the housing 30 in the state where the substrate-side connecting parts 13 project from the through holes 55 used for inserting conductive-terminals therein. And, the uneven engaging mechanism which is an engaging unit preventing the substrate-side connecting parts 13 of the conductive terminals 10 and 10*x* from moving to the bent parts 11, is provided between the projecting shoulder parts 15 of the conductive terminals 10 and the through holes 55.

The uneven engaging mechanism includes: the projecting shoulder parts 15 provided with the conductive terminals 10 and 10*x*; and the recessed holding parts 55*c* provided within the through holes 55 of the alignment member 50.

Accordingly, as shown in Figs. from 14 to 17, when the alignment member 50 temporally engaged with the openings 30*a* of the housing 30 are made to slide in the direction crossing the substrate-side connecting parts 13 of the conductive terminals 10 and 10*x* (direction approaching to the screen 34 of the housing 30), the projecting shoulder parts 15 of the conductive terminals 10 and 10*x* engage with the recessed holding parts 55*c* within the through holes 55, respectively.

Due to this, the substrate-side connecting parts 13 of the conductive terminals 10 and 10*x* are prevented from moving to the bent parts 11. As shown in FIG. 21, the substrate-side connecting parts 13 of the conductive terminals 10 and 10*x*, can be prevented from running to the bent parts 11 caused by press resistance upon attaching the circuit substrate 200 to the electrical connector 100.

Figure 13:
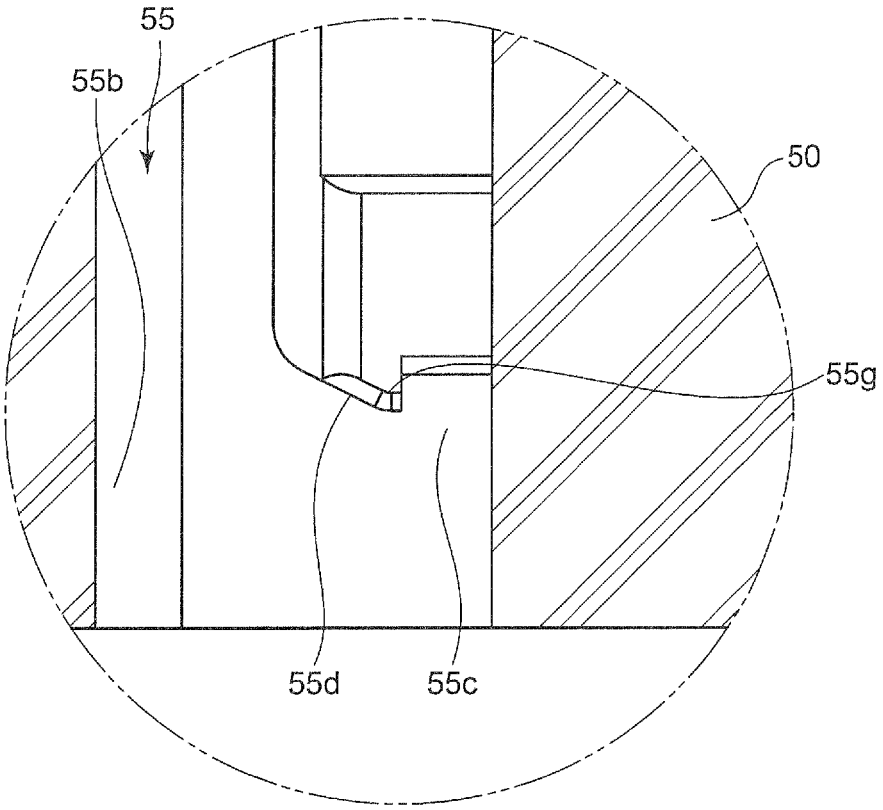
FIG. 13 is an enlarged view by arrow C in FIG. 11.

As shown in FIG. 12, FIG. 13, and FIG. 16, when the alignment member 50 is made to slide in the direction crossing the substrate-side connecting parts 13, the projecting shoulder parts 15 of the conductive terminals 10 and 10*x*, are smoothly fitted into the recessed holding parts 55*e*. This is because the guide surfaces 55*d* guiding the projecting shoulder parts 15 of the conductive terminals 10 and 10*x* toward the recessed holding parts 55*c*, are provided on the lower surfaces of the suspended parts 55*g* between the inner peripheral surfaces and the recessed holding parts 55*c* of the through holes 55.

The plurality of contact portions 13*b* including the press-fit mechanism, are provided with the substrate-side connecting parts 13 of the conductive terminals 10 and 10*x*. Accordingly, the circuit substrate 200 can be easily inserted into the through holes 201, and contact reliability after the insertion is also excellent.

Since the lock mechanism as shown in FIG. 18 is provided between the side pieces 51 of the alignment member 50 and the outer side walls 35 of the housing 30, the alignment member 50 attached with the openings 30*a* of the housing 30, can be prevented from undesired removing therefrom.

Having described preferred embodiments of the invention with reference to the accompanying drawings, it is to be understood that the invention is not limited to those precise embodiments, and that various changes and modifications may be effected therein by one skilled in the art without departing from the scope of the invention as defined in the appended claims.

The electrical connector 100 explained referring to Figs. from 1 to 21 shows a mere example of the present invention. In other words, the electrical connector according to the present invention is not limited to the electrical connector 100 exactly mentioned above.

INDUSTRIAL APPLICABILITY

The electrical connector according to the present invention can be widely employed in fields, such as an electrical-equipment industry, an automobile industry, and so on.

BRIEF DESCRIPTION OF SYMBOLS

10, 10*x*: Conductive terminal
10*a*: Body part
11: Bent part
12: Connector-side connecting part
13: Substrate-side connecting part
13*a*: Distal end
13*b*: Contact portion (Press-fit mechanism)
13*c*: Continuously-provided portion
13*d*: Guide section
14: Engaging portion
15: Projecting shoulder part (Engaging unit, uneven engaging mechanism)
15*a*: Upper surface
15*b*: Inclined surface
16: Wide area
17: Terminal holder
30: Housing
30*a*: Opening
30*b*: Upper surface
31: Terminal-holding hole
32: Opening
33: Partition
34: Screen
34*a*: Projection
35: Outer side wall
36: Inner side wall
36*a*: Recessed part
37: Notched portion
38, 39: Lock part (Lock mechanism)
39*a*: Recessed groove
40: Recessed portion
50: Alignment member
51: Side piece
52, 53: Lock part (Lock mechanism)
54: Recessed portion
55: Through hole
55*a*: Guide section
55*b*: Penetrating part
55*c*: Recessed holding part (Engaging unit, uneven engaging mechanism)
55*d*: Guide surface
55*e*: Projecting shoulder part inserting groove
55*f*: Moving path
55*g*: Suspended part
56: Bridge part
60, 70, 80: Jig
61: Contact surface
71: Holding recessed part
81: Hole
100: Electrical connector
200: Circuit substrate
201: Through hole
300: Housing
301: Inner surface

What is claimed is:

1. An electrical connector, comprising:

a conductive terminal including: a connector-side connecting part; a substrate-side connecting part; and an L-shaped bent part therebetween, the substrate-side connecting part being inserted into a circuit substrate in a thickness direction thereof;

a housing including: a terminal-holding hole holding the conductive terminal between the connector-side connecting part and the bent part; and an opening adapted to expose the substrate-side connecting part to the circuit substrate;

an alignment member attached toward the substrate-side connecting part of the conductive terminal so as to close the opening, the alignment member being engaged with the housing in a state where the substrate-side connecting part projects from a through hole for inserting the conductive terminal therein, wherein an engaging unit, preventing the substrate-side connecting part of the conductive terminal from moving to the bent part, is provided between the conductive terminal and the through hole; and the engaging unit includes an uneven engaging mechanism that engages with the conductive terminal when the alignment member attached through the opening slides in another direction orthogonal to the thickness direction and directly causes the terminal to be locked in the through hole.

2. The electrical connector as defined in claim 1, wherein the uneven engaging mechanism includes: a projecting shoulder part provided with the conductive terminal; and a recessed holding part provided in the through hole of the alignment member so as to fit the projecting shoulder part thereinto.

3. The electrical connector as defined in claim 2, wherein a guide surface, guiding the projecting shoulder part toward the recessed holding part, is provided between an inner peripheral surface of the through hole and the recessed holding part when the alignment member slides in the another direction.

4. The electrical connector as defined in claim 1, wherein the substrate-side connecting part of the conductive terminal includes a press-fit mechanism.

5. The electrical connector as defined in claim 1, further comprising:

a lock mechanism preventing the alignment member attached through the opening of the housing from being detached therefrom.

* * * * *